United States Patent [19]

Gluskin

[11] 4,328,871

[45] May 11, 1982

[54] POWER TOOL SPEED AND TORQUE CONTROL MECHANISM

[75] Inventor: Richard S. Gluskin, Devon, Pa.

[73] Assignee: SPS Technologies, Inc., Jenkintown, Pa.

[21] Appl. No.: 115,830

[22] Filed: Jan. 28, 1980

[51] Int. Cl.[3] ..... B25B 23/145

[52] U.S. Cl. ..... 173/12; 81/473; 192/0.034; 192/56 C

[58] Field of Search ..... 173/12; 81/469, 470, 81/473, 474; 192/0.033, 0.034, 56 C

[56] References Cited

U.S. PATENT DOCUMENTS

| | | | |
|---|---|---|---|
| 3,370,680 | 2/1968 | Bangerter et al. | 173/12 X |
| 3,696,871 | 10/1972 | Stenbacka | 173/12 |
| 3,739,659 | 6/1973 | Workman, Jr. | 173/12 X |
| 3,956,905 | 5/1976 | Thackston | 192/56 C X |
| 3,965,778 | 6/1976 | Aspers et al. | 173/12 X |
| 4,215,594 | 8/1980 | Workman, Jr. et al. | 173/12 X |
| 4,243,129 | 1/1981 | Schoeps | 192/56 C |

*Primary Examiner*—Robert Mackey

*Attorney, Agent, or Firm*—Aaron Nerenberg

[57] ABSTRACT

A power tool speed and torque control mechanism is disclosed. An improved clutch assembly is provided for power tools of the type having a high speed/low torque mode for rapidly engaging a threaded fastener and a low speed/high torque mode for tightening the fastener. The clutch assembly includes a wrap spring clutch having two springs.

6 Claims, 5 Drawing Figures

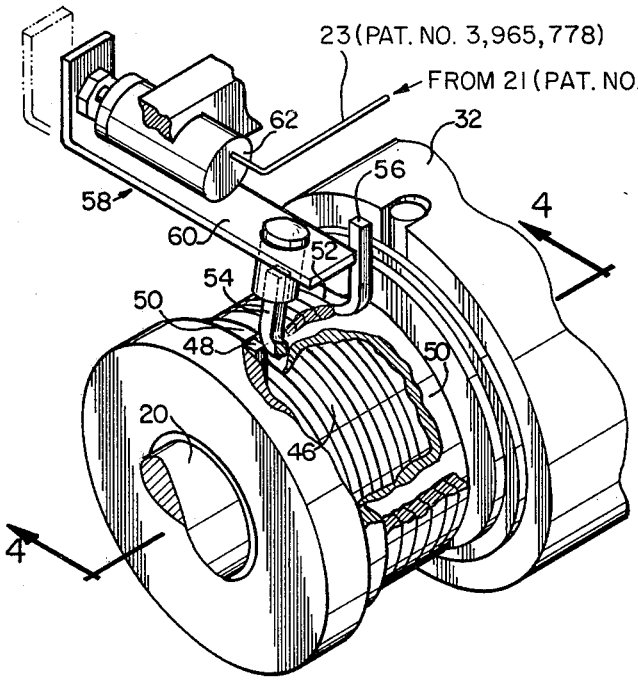
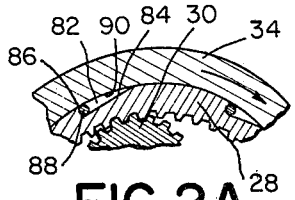
FIG. 2A
FIG. 3
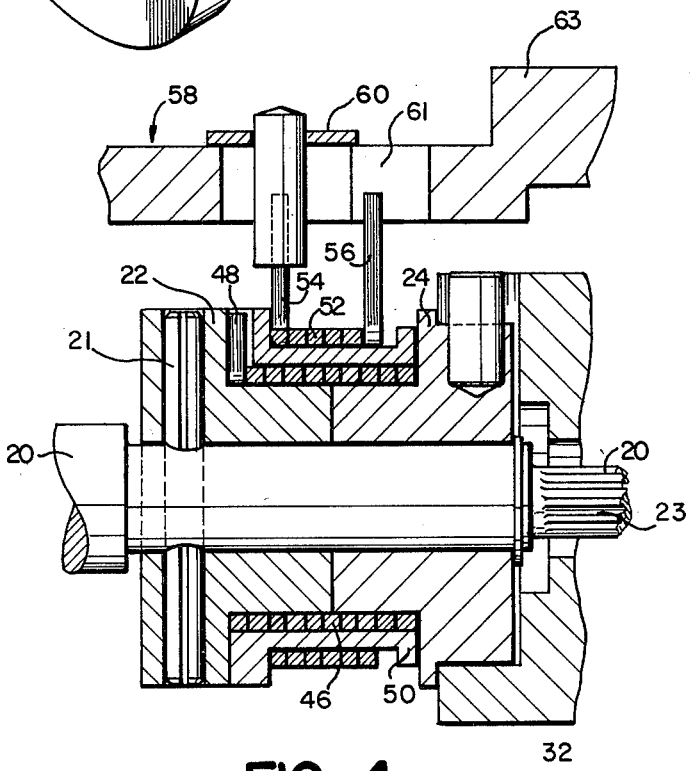
FIG. 4

POWER TOOL SPEED AND TORQUE CONTROL MECHANISM

BACKGROUND OF THE INVENTION

1. Field of the Invention

This invention relates to two speed power tools and clutches in general and two speed powered wrenches in particular.

It is generally recognized that it is desirable for powered wrenches to have a high speed/low torque mode and a low speed/high torque mode. The high speed/-low torque mode is used to quickly engage a threaded bolt to a nut or other structure until the bolt is seated while the low speed/high torque mode is used to tighten the bolt. The high speed/low torque mode significantly reduces the amount of time required to engage and tighten a bolt. This is important in assembly line operations where such a time saving may have dramatic cost reduction impact.

The shift from the high speed to low speed mode is generally accomplished by a clutch mechanism. The present invention provides an improved clutch in combination with such power tools.

2. Description of the Prior Art

A powered wrench of the general type herein discussed having a high speed/low torque and low speed/-high torque mode is taught by U.S. Pat. No. 3,696,871 issued to Stenbacka on Oct. 10, 1972. Stenbacka teaches a clutch having two rims, each of which have teeth. The rims are moveable with respect to one another so that a mode change is effected by engaging or disengaging the teeth from one another.

Clutches are also used in power tools for disengaging the wrench portion of such tools when an overload or predetermined torque is reached. A spring clutch is used for such a purpose in U.S. Pat. No. 3,956,905 issued to Thackston on May 18, 1976, and in U.S. Pat. No. 3,370,680 issued to Bangerter, et al, on Feb. 27, 1968.

Although the clutches used in two speed powered wrenches, such as that taught by Stenbacka, have generally been effective, the present invention represents an improvement. Through the use of a simpler design utilizing fewer parts, lower cost, greater reliability, faster action, and a longer service life is achieved.

SUMMARY OF THE INVENTION

The present invention provides a two speed powered wrench having an improved clutch and control mechanism to shift the wrench from a high speed/low torque mode to a low speed/high torque mode while tightening a threaded fastener, such as a bolt. The simplified clutch assembly utilizes a wrap spring clutch in conjunction with known two speed power wrenches. In the preferred embodiment a dual wrap spring clutch is utilized.

In the high speed/low torque mode the clutch is engaged, while in the low speed/high torque mode the clutch is disengaged. The clutch includes an input and output hub which are encompassed by an inner spring. When the inner spring is unrestrained, rotation of the input hub causes the inner spring to wind, thereby causing rotation of the output hub.

The inner spring is encompassed by a collar which is connected to a tab on the inner spring such that when the collar is held stationary or moved in the appropriate direction, the inner spring tends to be unwound, thereby disengaging the clutch. The collar is encompassed by an outer spring.

In the high speed mode, the outer spring is maintained in a slightly unwrapped condition, thereby permitting the collar to rotate. By permitting the collar to rotate, the inner spring is permitted to wind tightly. When the input hub is being driven the inner spring is thus permitted to wind tightly about and drive the output hub, thus engaging the clutch.

In order to disengage the clutch in order to shift to the low speed mode, the outer spring is tightened, thereby preventing rotation of the collar. By preventing rotation of the collar the inner spring tends to be unwound thereby causing the output hub not to be driven by the input hub.

The outer spring has tabs at its opposite ends. One of the tabs is maintained in a stationary position while the other tab is actuated by a piston. The spring is constructed and connected to the piston such that in the high speed mode when the clutch is engaged the tab is pulled so as to unwind the outer spring. By pushing the tab the outer spring is tightened thereby preventing the collar from rotating. This causes the clutch to disengage, causing the wrench to operate in its low speed mode.

It may be readily seen that the basic wrap spring clutch assembly includes three basic components, an input hub, an output hub, and a coil spring. These minimal number of components result in a clutch having greater reliability and a longer service life than those clutches used for a similar purpose shown in the prior art. The collar and the outer spring provide a greatly simplified and easy to use mechanism for actuating the inner spring.

Accordingly, it is an object of the present invention to provide a two speed power tool with an improved clutch mechanism to shift it from a high speed to a low speed mode.

It is an object of the present invention to provide a two speed power tool with a wrap spring clutch to shift it from a high speed to a low speed mode.

It is an object of the present invention to provide a two speed power tool having a wrap spring clutch with a simplified mechanism for actuating the spring.

It is another object of the present invention to provide a two speed power tool with a dual wrap spring clutch to shift it from a high speed to a low speed mode.

It is another object of the present invention to provide a wrap spring clutch with a simplified mechanism for actuating the spring.

It is still another object of the present invention to provide an improved wrap spring clutch having two springs, wherein one spring is used to actuate the other spring.

Other objects and a fuller understanding of the invention will be had by reference to the following description and claims of a preferred embodiment thereof taken in conjunction with the accompanying drawings wherein like numerals refer to like or similar parts throughout.

BRIEF DESCRIPTION OF THE DRAWINGS

FIG. 2A is a section view of the unidirectional clutch means taken along lines 2A—2A of FIG. 2.

FIG. 3 is a perspective view, partially broken away, of the clutch assembly partially shown in FIG. 2.

FIG. 4 is a section view of the clutch assembly taken along lines 4—4 of FIG. 3.

DESCRIPTION OF THE PREFERRED EMBODIMENT

Figure 1:
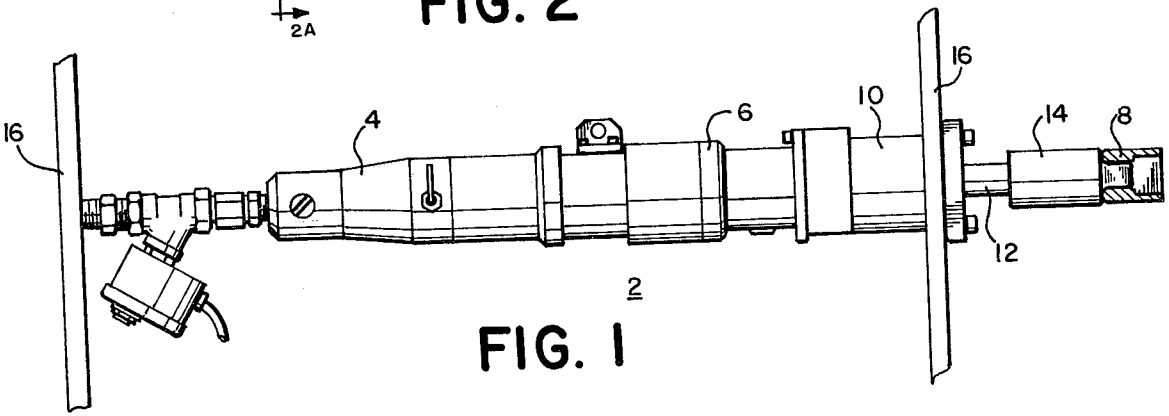
FIG. 1 is a perspective view of a powered tool incorporating the present invention.

Referring now to FIG. 1, a dual speed powered tool or wrench 2 is shown. The tool 2 includes a motor assembly 4, a downshift gear assembly 6, an output drive assembly 10, an output shaft 12, and an adapter 14. The adapter 14 engages a driver bit 8 which in turn engages the head of a bolt (not shown). The tool 2 is connected to frame members 16.

The motor 4, in the preferred embodiment is an air motor. However, the motor 4 may be of any suitable type, for example, electric, hydraulic, or any combination of pneumatic, electric or hydraulic. The power tool 2 is intended to be representative of any power tool wherein two speeds are desired. The power tool 2 of the preferred embodiment is an automatic wrench and is shown as a portion of an automatic tightening system and is intended to be representative of a variety of powered tools.

Figure 2:
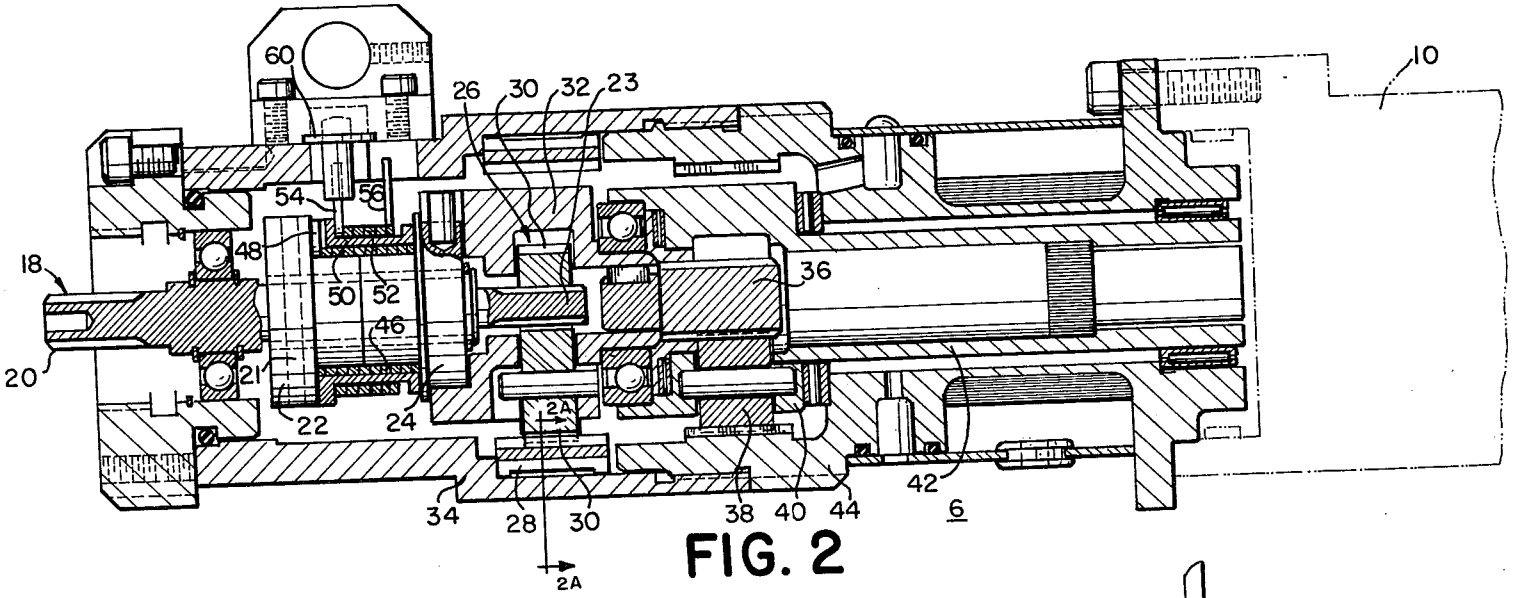
FIG. 2 is a section view of a portion of the tool shown in FIG. 1.

Referring now to FIG. 2 wherein the downshift gear assembly 6 is shown in greater detail, the downshift gear assembly 6 effectuates high speed to low speed mode shift of the tool. The downshift gear assembly 6 includes a clutch assembly 18. The clutch assembly has a shaft 20, which is driven by the motor assembly 4. Rigidly connected to the shaft 20 by a pin 21 is an input hub 22. An output hub 24 is also rotatably connected to the shaft 20. The clutch assembly 18 engages a planet gear assembly 26. The planet gear assembly 26 includes a ring gear 28, three planet gears 30 and a cage 32 for the planet gears 30. One end 23, of the shaft 20, functions as a sun gear and drives the planet gears 30. The ring gear 28 is connected to a non-rotatable housing 34, so that it may rotate within the housing 34 in a clockwise direction only, as viewed from the motor assembly 4. Conventional and well known means are used to provide an undirectional clutch arrangement which prevents ring gear 28 from rotating in the counterclockwise direction. Such undirectional clutch means are shown, for example, in U.S. Pat. No. 3,739,659 issued to Workman, Jr. on June 19, 1973. FIG. 2A, for example, shows such unidirectional clutch means used in the preferred embodiment of the present invention including ring gear 28, housing 34 and a plurality of cylindrical rollers 88. The exterior circumference of ring gear 28 is provided with spaced axially extending recesses 82 each having a radially sloping surface 84, and an aburpt edge 86. A cylindrical roller 88 is disposed in each recess and is engaged at each end by cylindrical washers (not shown) for holding the rollers. The washers are disposed adjacent each transverse end face of ring gear 28 for limited rotational movement with respect to the ring gear. Axial displacement of rollers 88 from the recesses 82 is prevented by appropriate conventional means (as illustrated in FIG. 1 and described at column 3, lines 34–50 of the Workman patent). The unidirectional clutch means operates in the following manner. Rollers 88 are so proportioned that when ring gear 28 is rotated in the direction indicated by the arrow in FIG. 2A, the rollers each engage the abrupt edges 86 and undergo rotational and sliding motion with respect to the internal cylindrical bearing surface 90 of housing 34. However, if ring gear 28 is rotated in the opposite direction, rollers 88 move up the sloping surfaces 84 until they are wedgingly engaged between the sloping surfaces 84 and bearing surface 90, thereby forcing ring gear 28 to become rotatably locked with respect to housing 34. A spindle gear 36 is connected to the cage 32 and serves as the output for the planet gear assembly 26.

As will hereinafter be discussed, the speed of spindle gear 36 will depend upon whether or not the output hub 24 of the clutch assembly 18 drives cage 32 of the planet gear assembly 26 causing it to rotate at the same speed as shaft 20.

Spindle gear 36 serves as the input for a second stage of gear reduction, which is permanently engaged. Spindle gear 36 causes three planet gears 38 to rotate. Rotation and revolution of the planet gears 38 causes their cage 40 to rotate. The cage 40 is rigidly connected to shaft 42 which in turn drives the output drive assembly 10 which causes rotation of the output shaft 12 of the power tool 2. The planet gears 38 revolve within a non-rotatable housing 44.

In operation, the clutch assembly 18 determines whether or not the planet gear assembly 26 is operating in a high speed/low torque or low speed/high torque mode. While initially engaging a threaded fastener, such as a nut or bolt, the powered tool 2 operates in a high speed/low torque mode. In this mode, the clutch assembly 18 is engaged so that the cage 32 is rotating at the same speed as shaft 20. Because there is no relative motion between shaft 20 and cage 32, the planet gears 30 do not rotate but revolve about shaft 20. The planet gears 30 drive ring gear 28 in a clockwise direction within housing 34. Since cage 32 is rotating at the same speed as shaft 20 and is the input to the second stage gear reduction, the planet gear assembly 26 does not provide any speed reduction.

When the nut or bolt is sufficiently threaded so that a predetermined resistance is met, the clutch assembly 18 is disengaged causing the planet gear assembly 26 to shift into its low speed/high torque mode. In this mode, the output hub 24 of the clutch assembly 18 is not driven but is free to rotate with respect to shaft 20. Shaft 20 drives the planet gears 30 of the planet gear assembly 26. The planet gears 30 in turn cause the cage 32 to rotate. Because of the planetary gearing the cage 32 rotates at a slower speed than shaft 20, thus effectuating a speed reduction. The planet gears 30 tend to rotate the ring gear 28 in a counterclockwise direction, but are prevented from doing so by using a unidirectional clutch arrangement which is well known in the art. In this mode, there is relative movement between the output hub 24 and the shaft 20. In the preferred embodiment, the planet gear assembly has a gear reduction ratio of 10 to 1.

Of course, since the cage 32 is rigidly connected to the output hub 24 of the clutch assembly 18, the output hub 24 rotates at the same speed as cage 32.

Description of the clutch assembly 18 will now be made with reference to FIGS. 3 and 4. The input hub 22 is shown rigidly connected to shaft 20 by pin 21. The output hub 24 is shown rotatably connected to shaft 20. A coil spring 46 is shown encompassing a portion of both the input hub 22 and the output hub 24. The spring 46 has a tab 48 connected to it. A collar 50 rotatably encompasses the spring 46 and engages tab 48. The spring 46 is wound counterclockwise, as viewed from the motor 4, and is mounted such that when the input hub 22 is turned clockwise the spring will wrap tightly around the input hub 22 and the output hub 24. If the tab 48 of the spring 46 is held stationary or rotated slightly in a counterclockwise direction, the spring 46 will be prevented from wrapping and rotation of the output hub 24 will be independent of the rotation of input hub 22 and shaft 20. Since the tab 48 of the spring 46 is engaged with collar 50, the movement and position of collar 50 will determine the position of the tab 48 and whether it is stationary or not.

A second spring 52 encompasses the collar 50 and is wrapped in a clockwise direction about the collar 50. The spring 52 has tabs 54 and 56 at its opposite ends. Tab 54 is connected to an actuator assembly 58 by arm 60. Tab 56 is secured to the assembly 58 so that is motion is limited in the clockwise direction by its being inserted in a hole 61 in member 63 as shown in FIG. 4. The member 63 and hole 61 are not shown in FIG. 3, in the interest of clarity.

When the powered tool 2 is in its high speed/low torque mode, arm 60 pushes tab 54 in a clockwise direction. Since the motion of tab 56 is limited in a clockwise direction this will tend to unwind the spring 52 causing its diameter to increase, thereby allowing the collar 50 to rotate freely. Clockwise rotation of shaft 20 and input hub 22 causes spring 46 to tighten, thereby engaging and causing output hub 24 to rotate. Rotation of output hub 24 causes rotation of cage 32, thus resulting in no gear reduction within the planet gear assembly 26.

When low speed/high torque is desired, the arm 60 is caused to pull the tab 54 of the outer spring 52 in a counterclockwise direction thus causing spring 52 to wrap tightly around collar 50 and drive it in the counterclockwise direction due to the relatively large diameter of hole 61 with respect to the size of the tab 56. Counterclockwise rotation of collar 50 results in counterclockwise rotation of tab 48 of inner spring 46 thereby causing the diameter of inner spring 46 to increase. Increasing the diameter of inner spring 46 causes the output hub 24 to be disengaged from the input hub 22 and allows the two hubs to rotate independently with respect to one another. This causes shaft 20 to rotate the planet gears 30 of the planet gear assembly 26, which in turn causes the cage 32 to rotate at a reduced speed and at an increased level of torque.

Still referring to FIGS. 3 and 4, the actuator assembly 58 includes arm 60 which actuates tab 54 of the outer spring 52. As previously indicated, in the normal and initial high speed/low torque mode the arm 60 pushes the tab 54 in a clockwise direction. The arm 60 is connected to a pneumatic actuator 62. Actuator 62 includes a spring loaded piston. The spring acts in such a way which causes the piston to be in a withdrawn or non-extended position. When it is desired to go to a low speed/high torque mode air is injected into the cylinder of the actuator 62 by control means (not shown) causing the piston to extend thus forcing the arm 60 in a counterclockwise direction, as is shown in phantom in FIG. 3. A control mechanism is required to inject air into actuator 62.

As has previously been indicated in the preferred embodiment of the invention, the motor 4 is an air motor. When the power tool 2 is used as a wrench to tighten a nut and bolt combination, the power tool 2 is in its normal high speed/low torque mode. When the fastener or bolt is seated, rotation of the output shaft 12 stops and hence the motor 4 stalls due to the motor not being able to provide a high enough torque output in this mode necessary to continue tightening the fastener. Non-rotation of the vanes of the air motor is sensed by a magnetic sensor (not shown) which is connected to conventional electronic circuitry that generates a signal when the motor 4 ceases to rotate for a few milliseconds. An example of such conventional circuitry is shown, for example, in U.S. Pat. No. 3,965,778 dated June 29, 1976 to Aspers et al. The disclosure of this patent is incorporated by reference herein. The electronic signal triggers a conventional solenoid valve 21 (from U.S. Pat. No. 3,965,778) which permits air to enter the actuator 62 through conduit 23 (from U.S. Pat. No. 3,965,778) causing its piston to extend and cause tab 54 to rotate in a counterclockwise direction. This, of course, causes the clutch assembly 18 to shift into a low speed/high torque mode. The control mechanism just described, although used in the preferred embodiment of the invention, is representative of many different types which could also be used.

In the foregoing, there has been disclosed a preferred embodiment of the invention and it should be obvious to one skilled in the art that various modifications and changes may be made without departing from the true spirit and scope of the invention as recited in the appendant claims.

What I claim is:

1. A two speed power tool having an output member, said tool comprising:

a motor having an output shaft;

a wrap spring clutch assembly operatively connected to said motor output shaft, said clutch assembly having a first spring and a second spring wound in opposite directions to each other, and means operatively interconnecting said first and said second springs, whereby said second spring actuates said first spring;

first means for changing the output member operational speed, said first means being operatively connected to said clutch assembly and to the output member; and second means operatively connected to said clutch assembly second spring for selectively engaging and disengaging said clutch assembly in response to a signal indicating that the speed of said motor has reached a predetermined condition, whereby the tool is caused to shift from a higher speed and lower torque capability to a lower speed and higher torque capability.

2. The two speed power tool of claim 1 wherein said clutch assembly further comprises:

an input shaft having a first end and a second end, said first end being connected to said motor output shaft and said second end being operatively connected to said first means;

an input hub rigidly connected to said input shaft;

an output hub rotatably connected to said input shaft and rigidly connected to said first means, and wherein said first spring encompasses said input hub and said output hub; and wherein said means operatively interconnecting said first and said second springs comprises a collar encompassing said first spring, said first spring having an engagement means operatively engaged by said collar, and wherein said second spring encompasses said collar, said second spring having a first connection means at one end thereof operatively connected to said second means whereby when said second means engages said first connection means rotation of said input shaft will not cause rotation of said output hub and when said second means disengages said first connection means said first spring will tighten and cause said output hub to rotate at the same speed as said input shaft.

3. The two speed power tool of claim 2 wherein said first means is a planet gear assembly.

4. The two speed power tool of claim 3 wherein said planet gear assembly further comprises:

a sun gear rigidly connected to said input shaft second end;

a plurality of planet gears engaged with said sun gears;

a cage rotatably connected to each of said planet gears, said cage being rigidly connected to said output hub of said clutch assembly and operably connected to said tool output member; and a ring gear engaged with said planet gears and being operatively connected to the tool, said ring gear having unidirectional clutch means associated therewith and being operably rotatable in one direction only, whereby engagement of said clutch assembly causes said cage to rotate at the same speed as said input shaft and disengagement of said clutch assembly causes said cage to rotate at a speed less than said input shaft speed.

5. The two speed power tool of claims 2, 3 or 4 wherein said second spring further includes second connection means at the other end thereof, and wherein said second means includes means for preventing rotation of said second spring second connection means, an arm connected to said second spring first connection means, and actuator means connected to said arm for receiving said signal indicating that the speed of said motor has reached a predetermined condition and actuating said arm in response to said signal.

6. The two speed power tool of claim 5 wherein the predetermined condition is when the motor stalls.

* * * * *